US005447900A

United States Patent [19]

Suzaki et al.

[11] Patent Number: 5,447,900

[45] Date of Patent: Sep. 5, 1995

[54] THERMOSENSITIVE RECORDING MATERIAL

[75] Inventors: Hideo Suzaki, Numazu; Keishi Taniguchi, Susono; Kunio Hayakawa, Gotenba; Hiromi Furuya, Shimizu, all of Japan

[73] Assignee: Ricoh Company, Ltd., Tokyo, Japan

[21] Appl. No.: 305,913

[22] Filed: Sep. 15, 1994

[30] Foreign Application Priority Data

Sep. 17, 1993 [JP] Japan ..... 5-254720
Aug. 18, 1994 [JP] Japan ..... 6-216545
Sep. 8, 1994 [JP] Japan ..... 6-240653

[51] Int. Cl.[6] ..... B41M 5/30; B41M 5/40

[52] U.S. Cl. ..... 503/207; 503/216; 503/221; 503/226

[58] Field of Search ..... 427/150, 151; 503/207, 503/216, 221, 226

[56] References Cited

U.S. PATENT DOCUMENTS 5,306,687 4/1994 Furuya et al. .
5,328,754 7/1994 Yuyama et al. .

*Primary Examiner*—B. Hamilton Hess
*Attorney, Agent, or Firm*—Oblon, Spivak, McClelland, Maier, & Neustadt

[57] ABSTRACT

A thermosensitive recording material having a support and a thermosensitive coloring layer which is formed on the support and contains a leuco dye and a color developer capable of inducing color formation in the leuco dye upon application of heat thereto, with the color developer including one compound with an acid dissociation constant (pKa) of 7.0 or less in a mixed solvent of water and methanol with a volume ratio of 1:1.

8 Claims, No Drawings

THERMOSENSITIVE RECORDING MATERIAL

BACKGROUND OF THE INVENTION

1. Field of the Invention

The present invention relates to a thermosensitive recording material comprising as the main components a leuco dye serving as a coloring agent and a color developer capable of inducing color formation in the leuco dye upon application of heat thereto.

2. Discussion of Background

There are conventionally proposed various recording materials which utilize the coloring reaction between a colorless or light-colored leuco dye and a color developer capable of inducing color formation in the leuco dye upon application of heat or pressure thereto when brought into contact with the leuco dye.

A thermosensitive recording material, one of the above-mentioned recording materials, is usable as a recording material for an electronic computer, facsimile apparatus, ticket vending apparatus, label printer, and recorder because it has the advantages that complicated processes such as development and image-fixing are not required, recording can be achieved for a short period of time using a relatively simple apparatus, there is no noise development, and the manufacturing cost is low.

In such a thermosensitive recording material, colorless or light-colored leuco dyes having a lactone, lactam, or a spiropyran ring are used as coloring dyes, and organic acids or phenols are conventionally employed as color developers. The thermosensitive recording material using the above-mentioned leuco dye and color developer is widely used for practical use because the produced images have high density, with the whiteness of the background maintained high.

In recent years, in line with diversified usage for the thermosensitive recording materials, there is an increasing demand for the improvement of quality of the thermosensitive recording material. In particular, when great importance is attached to the reliability of the recorded image, the requirements for the preservation stability of the recorded image, specifically, the resistance to oil and plasticizer of the images are increasing. The development of a recording material which can satisfy such requirements is therefore intensively desired.

In addition, a bar code reader employing a semiconductor laser beam is mainly used for the system of point-of-sales (POS). Such a semiconductor laser beam has a wavelength of 650 nm or more, mainly 680 nm or more, from the visible light range to the near infrared range. Therefore, it is necessary that bar code images absorb the visible rays and the near infrared rays within the above-mentioned range.

To improve the preservation stability of the image recorded in the thermosensitive recording material, it is proposed to use as the color developer a phenolsulfone compound, as disclosed in Japanese Laid-Open Patent Applications 58-82788 and 60-13852; a metallic salt of benzoic acid, as disclosed in Japanese Laid-Open Patent Application 61-47292; and a substituted salicylic acid compound, as disclosed in Japanese Laid-Open Patent Application 62-169681. Even though the aforementioned compounds are used as the color developers, the fastness to oils, plasticizers and water of the image areas obtained in the recording materials is not sufficient.

The formation of an intermediate layer is proposed to increase the recording sensitivity. For instance, there are proposed an intermediate layer comprising a variety of inorganic pigments, and an intermediate layer comprising non-expandable void particles. However, these recording materials have the shortcomings that the thermal coloring sensitivity is insufficient and the recording properties are poor.

As previously mentioned, images are formed in the thermosensitive recording material when an electron-acceptor material serving as a coloring developer induces the color formation in a dye upon application of heat thereto. To read such images using the semiconductor laser beam, it is required that the images have absorption intensity in the wavelength of 650 nm or more, preferably 680 nm or more. However, the image formed by the coloring reaction between the conventional leuco dye and phenol compound cannot sufficiently absorb the light with the aforementioned wavelength. In addition to this, the images thus formed in the recording material are lacking in reliability. Therefore, such a conventional thermosensitive recording material is not useful in practice.

As disclosed in Japanese Laid-Open Patent Application 62-85986, modification of the structure of a dye for use in a thermosensitive recording material makes it possible to read the images recorded in the thermosensitive recording material by the semiconductor laser beam. This method, however, is not practical from the viewpoint of manufacturing cost.

SUMMARY OF THE INVENTION

Accordingly, an object of the present invention is to provide a thermosensitive recording material capable of speedily recording images therein and readily reading the recorded images by the application thereto of a semiconductor laser beam, with the recorded images being stored in a good condition.

The above-mentioned object of the present invention can be achieved by a thermosensitive recording material comprising a support and a thermosensitive coloring layer formed on the support which comprises a leuco dye and a color developer capable of inducing color formation in the leuco dye upon application of heat thereto, with the color developer comprising at least one compound with an acid dissociation constant (pKa) of 7.0 or less, preferably 4.5 or less, in a mixed solvent of water and methanol with a volume ratio of 1:1.

DESCRIPTION OF THE PREFERRED EMBODIMENTS

A color developer used in a thermosensitive recording material according to the present invention comprises at least one compound with an acid dissociation constant (pKa) of 0 to 7.0 in a mixed solvent of water and methanol with a volume ratio of 1:1. Therefore, the preservation stability of the recorded images against oils and plasticizers can be improved when images are recorded in the thermosensitive recording material of the present invention.

The acid dissociation constant (pKa) indicates the intensity of Brensted acid in a solvent, which is expressed by the following formulas:

$$HA+S=HS^{+}+A^{-},$$

wherein HA is a Brensted acid, and S is a solvent.

$$Ka = \frac{[HS^+][A^-]}{([HA] + [HS^+ \cdot A^-])}$$

$$pKa = -\log(Ka)$$

When the acid dissociation constant of the color developer exceeds 7.0, the coloring sensitivity of the recording material is decreased, and the resistance to oil and plasticizer of the recorded image is poor.

Any electron aeceptor with the above-mentioned acid dissociation constant may be employed as the color developer in the present invention. In particular, an electron acceptor having the following formula (1) is preferably employed:

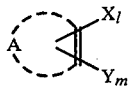

(1)

wherein A is a radical necessary for forming an aromatic ring which may have a hetero atom; X is a carboxylic acid group, a sulfonic acid group, a sulfinic acid group or a combination of the above groups; Y is hydrogen, a halogen, a nitro group, an alkyl group which may have a substituent, an aryl group, an acyl group, an alkoxyl group, a sulfonyl group, an aralkyl group, or an amino group; l is an integer of 1 to 5, preferably 1 to 3; and m is an integer of 1 to 7.

For Y in formula (1), an alkyl group having 1 to 18 carbon atoms and an aryl group are desirable. Specific examples are as follows:

(1) alkyl group which may have a substituent selected from the group consisting of a halogen, a carbonyl group, a cyano group, an alkoxycarbonyl group, an aryloxycarbonyl group, a carbamoyl group, a substituted amino group, an ureide group, a thioureide group, an aryl group, an aryloxy group and a hydroxyl group, for instance, methyl group, ethyl group, propyl group, butyl group, dimethylbutyl group, isobutyl group, amyl group, neopentyl group, hydroxyethyl group, cyclopentyl group, isoamyl group, cyclohexylmethyl group, methylcyclohexyl group, cyclohexyl group, chloropropyl group, phenoxyethyl group, phenoxypropyl group, phenoxybutyl group, phenylethyl group, phenylpropyl group, phenylbutyl group, dodecyl group, benzyl group, α-phenetyl group, β-phenetyl group, β-ethoxyethyl group, β-4-methoxyphenoxyethyl group, naphthoxyethyl group, 4-phenylcyclohexyl group, 4-ethoxyphenoxybutyl group, naphthoxyethoxyethyl group, tolyloxyethyl group, 4-nitrocinnamyl group, thiophenoxyethyl group, crotyl group, geranyl group, 4-cyclohexylphenoxyethyl group, 3-oxocyclohexyl group, 4-carboxyphenoxyethyl group, naphthoxybutyl group, pyridylethyl group, allyl group, dichlorophenoxyethyl group, trichlorophenoxybutyl group, 2,4,6-trimethylphenoxyethyl group, cinnamyl group, β-methacrylamidoethyl group, and nitropropyl group.

(2) phenyl group or naphthyl group, which may have at least one substituent selected from the group consisting of an alkyl group, an aryl group, an alkoxyl group, an aryloxy group, a halogen, a cyano group, a nitro group, an acyl group, an arylsulfonyl group, a hydroxyl group, a carboxyl group, a sulfamoyl group, a substituted amino group and a carbamoyl group, for instance, chlorophenyl group, tolyl group, dimethylphenyl group, 2-methyl-4-chlorophenyl group, p-methoxyphenyl group, o-methoxyphenyl group, acetylphenyl group, biphenyl group, ethoxycarbonylphenyl group, ethylphenyl group, hydroxyphenyl group, difluorophenyl group, propionylaminophenyl group, cyclohexylphenyl group, butoxycarbonylphenyl group, benzenesulfonylphenyl group, methanesulfonylphenyl group, benzylphenyl group, methoxycumylphenyl group, cumylphenyl group, t-octylphenyl group, t-aminophenyl group, benzyloxycarbonylphenyl group, phenoxycarbonylphenyl group, butylnaphthyl group, dimethoxycarbonylphenyl group, and phenoxysulfonylphenyl group.

Specific examples of the compound having an acid dissociation constant (pKa) of 7.0 or less, serving as the color developer for use in the present invention are shown in Table 1:

TABLE 1

| Compound No. | Compound | Acid Dissociation Constant |
|---|---|---|
| 1 | 4-(4'-phenoxybutoxy)phthalic acid 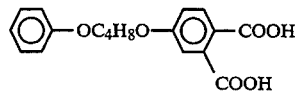 | pKa1 = 3.55<br>pKa2 = 6.59 |
| 2 | 4-(2'-phenoxyethoxy)phthalic acid 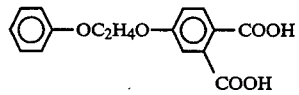 | pKa1 = 3.63<br>pKa2 = 6.63 |
| 3 | 4-(3'-phenylpropyloxy)-phthalic acid 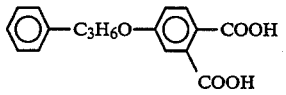 | pKa1 = 3.60<br>pKa2 = 6.65 |
| 4 | mono(2-hydroxyethyl)5-nitroisophthalate 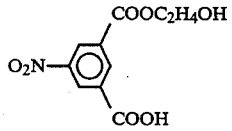 | pKa = 3.80 |
| 5 | monomethyl 5-nitroisophthalate 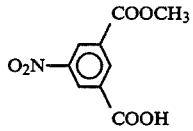 | pKa = 3.83 |
| 6 | 5-benzylsulfonylbenzoic acid 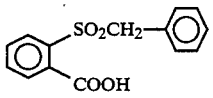 | pKa = 3.73 |
| 7 | 5-benzyloxycarbonyl iso-phthalic acid 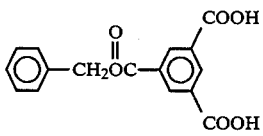 | pKa1 = 4.20<br>pKa = 4.87 |

TABLE 1-continued

| Compound No. | Compound | Acid Dissociation Constant |
|---|---|---|
| 8 | 5-(1'-phenylethanesulfonyl)-isophthalic acid 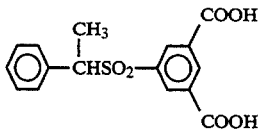 | pKa1 = 4.28<br>pKa = 4.83 |

In Table 1, the acid dissociation constant of a compound was measured by the following method:

A commercially available pH meter "HORIBA N-8F" (Trademark), made by Horiba Ltd., equipped with three composite electrodes, was calibrated by using the following two solutions:

(1) pH=5.13 (at 25° C.)

Water/methanol solution (with a volume ratio of 1:1) containing 0.05 mol/l potassium hydrogenphthalate.

(2) pH=7.90 (at 25° C.)

Water/methanol solution (with a volume ratio of 1:1) containing 0.01 mol/l tris(hydroxy)aminomethane and 0.01 mol/l tris(hydroxy)aminomethane hydrochloride.

Then, a solution A was prepared in such a manner that 0.4969 g of 4-(4'-phenoxybutoxy)phthalic acid (Compound No. 1 in Table 1) and 0.5844 g of sodium chloride,were dissolved in a mixed solvent consisting of 50 ml of water and 50 ml of methanol.

In addition, a 0.1068 mol/l sodium hydroxide aqueous solution was prepared by standardizing the solution with potassium hydrogen-phthalate. This solution was hereinafter referred to as a solution B.

The solution A was placed in a beaker and stirred with a stirrer. The solution B was added dropwise in an amount of 0.5 to 1.0 ml to the solution A, with stirring, through a buret. When the pH of the solution A reached a constant value, the pH was measured. The pH was further measured with further addition of the solution B to the solution A, so that a titration curve was obtained. This titration curve was fitted in a theoretical formula by using a computer program, so that an acid dissociation constant of the compound No. 1 was calculated.

As a result, the acid dissociation constants, pKal and pKa2, of 4-(4'-phenoxybutoxy)phthalic acid were respectively 3.55 and 6.59.

In the case where a compound having a plurality of electron accepting groups such as a carboxylic acid group and a sulfonic acid group is used as the color developer, it is supposed that all the electron accepting groups contribute to the coloring reaction.

The thermosensitive coloring layer of the recording material according to the present invention comprises a leuco dye serving as a coloring agent and a color developer.

As the leuco dye for use in the present invention, which may be employed alone or in combination, any conventional dyes for use in the conventional leuco-dye-containing recording materials can be employed. For example, triphenylmethanephthalide leuco compounds, triallylmethane leuco compounds, fluoran leuco compounds, phenothiazine leuco compounds, thiofluoran leuco compounds, xanthene leuco compounds, azaphthalide leuco compounds, couromenopyrazole leuco compounds, methine leuco compounds, Auramine leuco compounds, spiropyran leuco compounds, indolinophthalide leuco compounds, rhodamineanilinolactam leuco compounds, rhodaminelactam leuco compounds, quinazoline leuco compounds, diazaxanthene leuco compounds and bislactone leuco compounds are preferably employed. Specific examples of those leuco dyes are as follows:

3-N,N-dibutylamino-6-methyl-7-anilinofluoran,
3,3-bis(p-dimethylaminophenyl)phthalide,
3,3-bis(p-dimethylaminophenyl)-6-dimethylaminophthalide,
3,3-bis(p-dimethylaminophenyl)-6-diethylaminophthalide,
3,3-bis(p-dimethylaminophenyl)-6-chlorophthalide,
3,3-bis(p-dibutylaminophenyl)phthalide,
3-cyclohexylamino-6-chlorofluoran,
3-dimethylamino-5,7-dimethylfluoran,
3-(N-methyl-N-isoamylamino)-6-methyl-7-anilinofluoran,
3-(N-methyl-N-isobutylamino)-6-methyl-7-anilinofluoran,
3-(N-p-tolyl-N-ethylamino)-6-methyl-7-anilinofluoran,
3-(N-methyl-N-amylamino)-6-methyl-7-anilinofluoran,
3-(N,N-di-n-amylamino)-6-methyl-7-anilinofluoran,
3-(N-methyl-N-cyclohexylamino)-6-methyl-7-anilinofluoran,
3-(N-methyl-N-iso-propylamino)-6-methyl-7-anilinofluoran,
3-(N-ethyl-N-iso-propylamino)-6-methyl-7-anilinofluoran,
3-(N-ethyl-N-tetrahydrofurfurylamino)-6-methyl-7anilinofluoran,
3-diethylamino-7,8-benzfluoran,
3-diethylamino-7-chlorofluoran,
3-diethylamino-7-methylfluoran,
3-diethylamino-6-methyl-7-chlorofluoran,
3-pyrrolidino-6-methyl-7-anilinofluoran,
3-diethylamino-6-methyl-7-(m-trichloroanilino)fluoran,
3-diethylamino-7-(o-chloroanilino)fluoran,
3-dibutylamino-7-(o-chloroanilino)fluoran,
3-diethylamino-6-methyl-7-anilinofluoran,
3-dibutylamino-6-methyl-7-anilinofluoran,
3-dihexylamino-6-methyl-7-anilinofluoran,
3-(N-ethyl-N-isoamyl)-6-methyl-7-anilinofluoran,
3-diethylamino-6-methyl-7-(2',4'-dimethylanilino)fluoran,
3-(N,N-diethylamino)-5-methyl-7-(N,N-dibenzylamino)fluoran,
benzoyl leuco methylene blue,
6'-chloro-8'-methoxy-benzoindolinospiropyran,
6'-bromo-8'-methoxy-benzoindolinospiropyran,
3-(2,-hydroxy-4'-dimethylaminophenyl)-3-(2'-methoxy-5'-chlorophenyl)phthalide,
3-(2,-hydroxy-4'-dimethylaminophenyl)-3-(2'-methoxy-5'-nitrophenyl)phthalide,
3-(2,-hydroxy-4'-diethylaminophenyl)-3-(2'-methoxy-5'-methylphenyl)phthalide,
3-(2,-methoxy-4'-dimethylaminophenyl)-3-(2'-hydroxy-4'-chloro-5'-methylphenyl)phthalide,
3-morphorino-7-(N-propyl-trifluoromethylanilino)fluoran,
3-pyrrolidino-7-trifluoromethylanilinofluoran,
3-diethylamino-5-chloro-7-(N-benzyl-trifluoromethylanilino)fluoran
3-pyrrolidino-7-(di-p-chlorophenyl)methylaminofluoran,
3-diethylamino-5-chloro-7-(α-phenylethylamino)fluoran,
3-(N-ethyl-p-toluidino)-7-(α-phenylethylamino)fluoran, 3-diethylamino-7-(o-methoxycarbonylphenylamino)-fluoran,
3-diethylamino-5-methyl-7-(α-phenylethylamino)fluoran,
3-diethylamino-7-piperidinofluoran,
2-chloro-3-(N-methyltoluidino)-7-(p-N-butylanilino)-fluoran,
3,6-bis(dimethylamino)fluorenespiro(9,3')-6'-dimethylaminophthalide,
3-(N-ethyl-N-cyclohexylamino)-5,6-benzo-7-α-naphtylamino-4'-bromofluoran,
3-diethylamino-6-chloro-7-anilinofluoran,
3-(N-ethyl-N-2-ethoxypropylamino)-6-methyl-7-anilino fluoran,
3-(N-ethyl-N-tetrahydrofurfurylamino)-6-methyl-7-anilinofluoran,
3-diethylamino-6-methyl-7-mesidino-4',5'-benzofluoran,
3-(p-dimethylaminophenyl)-3-[1,1-bis(p-dimethylaminophenyl)ethylene-2-yl]phthalide,
3-(p-dimethylaminophenyl)-3-[1,1-bis(p-dimethylaminophenyl)ethylene-2-yl]-6-dimethylaminophthalide,
3-(p-dimethylaminophenyl)-3-(1-p-dimethylaminophenyl-1-phenylethylene-2-yl)phthalide,
3-(p-dimethylaminophenyl)-3-(1-p-dimethylaminophenyl-1-p-chlorophenylethylene-2-yl)-6dimethylaminophthalide,
3-(4'-dimethylamino-2'-methoxy)-3-(1''-p-dimethylaminophenyl-1''-p-chlorophenyl-1'',3''-butadiene-4''-yl)benzophthalide,
3-(4'-dimethylamino-2'-benzyloxy)-3-(1''-p-dimethylaminophenyl-1''-phenyl-1'',3''-butadiene-4''-yl)benzophthalide,
3-dimethylamino-6-dimethylamino-fluorene-9-spiro-3'-(6'-dimethylamino)phthalide,
3,3-bis[2-(p-dimethylaminophenyl )-2-(p-methoxyphenyl)ethenyl]-4,5,6,7 -tetrachlorophthalide,
3-bis[1,1-bis(4-pyrrolidinophenyl)ethylene-2-yl]-5,6-dichloro-4,7-dibromophthalide,
bis(p-dimethylaminostyryl)-1-naphthalenesulfonylmethane, and
bis(p-dimethylaminostyryl)-1-p-tolylsulfonylmethane.

Of the above-mentioned leuco dyes, 3-N,N-dibutylamino-6-methyl-7-anilinofluoran is preferably employed in combination with the above-mentioned color developer with an acid dissociation constant as previously specified in the thermosensitive recording material of the present invention. When 3-N,N-dibutylamino-6-methyl-7-anilinofluoran and at least one compound with the above-mentioned acid dissociation constant are employed in the thermosensitive coloring layer, the images formed in such a thermosensitive recording material have the absorption intensity in the near infrared region as well as the visible light range of electromagnetic wave.

Generally, it is required that an image recorded in the thermosensitive recording material have a PCS (print contrast signal) of 75% or more when read by semiconductor laser beam of 680 nm. Further, it is desirable that. an initial PCS value be as high as 85% or more when consideration is given to the preservability of the recorded image. In the case of the thermosensitive recording material of the present invention, the initial PCS value of the recorded image is 85% or more. In addition, the PCS value scarcely decreases with time because the preservability of the recorded image is excellent.

The color developer for use in the present invention comprises a compound with the above-mentioned acid dissociation constant. In addition to this compound, a variety of electron-acceptors capable of inducing color formation in the leuco dye upon application of heat thereto when brought into contact with the leuco dye, for instance, phenolic compounds, thiophenolic compounds, thiourea derivatives, organic acids and metallic salts thereof can be employed. Specific examples of the color developer are as follows:

4,4'-isopropylidenebisphenol,
4,4'-isopropylidenebis(o-methylphenol),
4,4'-sec-butylidenebisphenol,
4,4,-isopropylidenebis(o-tert-butylphenol),
4,4'-cyclohexylidenediphenol,
4,4'-isopropylidenebis(2-chlorophenol),
2,2'-methylenebis(4-methyl-6-tert-butylphenol),
2,2'-methylenebis(4-ethyl-6-tert-butylphenol),
4,4'-butylidenebis(6-tert-butyl-2-methyl)phenol,
1,1,3-tris(2-methyl-4-hydroxy-5-tert-butylphenyl)butane,
1,1,3-tris(2-methyl-4-hydroxy-5-cyclohexylphenyl)butane,
4,4'-thiobis(6-tert-butyl-2-methylphenol),
4,4'-diphenolsulfone,
4-isopropoxy-4'-hydroxydiphenylsulfone,
4-benzyloxy-4'-hydroxydiphenylsulfone,
4,4'-diphenolsulfoxide,
isopropyl p-hydroxybenzoate,
benzyl p-hydroxybenzoate,
benzyl protocatechuate,
stearyl gallate,
lauryl gallate,
octyl gallate,
1,7-bis(4-hydroxyphenylthio)-3,5-dioxaheptane,
1,5-bis(4-hydroxyphenylthio)-3-oxapentane,
1,3-bis(4-hydroxyphenylthio)-propane,
1,3-bis(4-hydroxyphenylthio)-2-hydroxypropane,
N,N'-diphenylthiourea,
N,N'-di(m-chlorophenyl)thiourea,
salicylanilide,
5-chloro-salicylanilide,
2-hydroxy-3-naphthoic acid,
2-hydroxy-1-naphthoic acid,
1-hydroxy-2-naphthoic acid,
zinc hydroxynaphthoate,
aluminum hydroxynaphthoate,
calcium hydroxynaphthoate,
bis(4-hydroxyphenyl)methyl acetate,
bis(4-hydroxyphenyl)benzyl acetate,
1,3-bis(4-hydroxycumyl)benzene,
1,4-bis(4-hydroxycumyl)benzene,
2,4'-diphenolsulfone,
3,3'-diallyl-4,4'-diphenolsulfone,
α,α-bis(4-hydroxyphenyl)-α-methyltoluene,
antipyrine complex of zincthiocyanate,
tetrabromobisphenol A,
tetrabromobisphenol S,
4,4'-thiobis(2-methylphenol), and
4,4'-thiobis(2-chlorophenol).

To obtain a thermosensitive recording material according to the present invention, a variety of conventional binder agents can be employed in the thermosensitive coloring layer for binding the above-mentioned leuco dyes, color developers, and auxiliary components to be described later, to the support of the thermosensitive recording material.

As the binder agent for use in the present invention, any conventional binder agents used in the conventional thermosensitive recording materials can appropriately be employed. Examples of the binder agent are water-soluble polymers such as polyvinyl alcohol, starch and starch derivatives, cellulose derivatives such as methoxy cellulose, hydroxymethyl cellulose, hydroxyethyl cellulose, carboxymethyl cellulose, methyl cellulose, and ethyl cellulose, sodium polyacrylate, polyvinyl pyrrolidone, acrylamide—acrylic ester copolymer, acrylamide—acrylic ester—methacrylic acid terpolymer, alkali salts of styrene—maleic anhydride copolymer, alkali salts of isobutylene—maleic anhydride copolymer, polyacrylamide, sodium alginate, gelatin, and casein; emulsions such as polyvinyl acetate, polyurethane, polyacrylic acid, polyacrylic ester, vinyl chloride—vinyl acetate copolymer, polymethacrylic ester including polybutyl methacrylate, and ethylene—vinyl acetate copolymer; and latexes such as styrene—butadiene copolymer and styrene—butadiene—acrylic copolymer.

According to the present invention, the thermosensitive coloring layer may further comprise a thermofusible material as the thermosensitivity-improving agent.

Specific examples of the thermofusible material are as follows: fatty acids such as stearic acid and behenic acid; fatty amides such as stearamide and palmitamide; fatty acid metallic salts such as zinc stearate, aluminum stearate, calcium stearate, zinc palmitate, and zinc behenate; and p-benzylbiphenyl, terphenyl, triphenylmethane, benzyl p-benzyloxybenzoate, β-benzyloxy naphthalene, phenyl β-naphthoate, phenyl 1-hydroxy-2-naphthoate, methyl 1-hydroxy-2-naphthoate, diphenyl carbonate, guaiacol carbonate, dibenzyl terephthalate, dimethyl terephthalate, 1,4-dimethoxynaphthalene, 1,4-diethoxynaphthalene, 1,4-dibenzyloxynaphthalene, 1,2-diphenoxyethane, 1,2-bis(3-methylphenoxy)ethane, 1,2 -bis(4-methylphenoxy)ethane, 1,4-diphenoxybutane, 1,4-diphenoxy-2-butene, 1,2-bis(4-methoxyphenylthio)ethane, dibenzoylmethane, 1,4-diphenylthiobutane, 1,4-diphenylthio-2-butene, 1,3-bis(2-vinyloxyethoxy)benzene, 1,4-bis(2-vinyloxyethoxy)benzene, p-(2-vinyloxyethoxy)biphenyl, p-aryloxybiphenyl, p-propargyloxybiphenyl, dibenzoyloxymethane, dibenzoyloxypropane, dibenzyl disulfide, 1,1-diphenylethanol, 1,1-diphenylpropanol, p-(benzyloxy)-benzyl alcohol, 1,3-phenoxy-2-propanol, N-octadecylcarbamoyl-p-methoxycarbonylbenzene, N-octadecylcarbamoylbenzene, 1,2-bis(4-methoxyphenoxy)propane, 1,5bis-(4-methoxyphenoxy)-3-oxapentane, dibenzyl oxalate, bis(4-methylbenzyl)oxalate, bis(4-chlorobenzyl)oxalate, and 4-chlorobenzoic acid-4'-methylphenyl ester.

When necessary, the thermosensitive coloring layer for use in the present invention may further comprise auxiliary additive components such as a filler, a surface active agent, a lubricant and an agent for preventing color formation by pressure application, which are used in the conventional thermosensitive recording materials.

Examples of the filler for use in the present invention are finely-divided particles of inorganic fillers such as calcium carbonate, silica, zinc oxide, titanium oxide, aluminum hydroxide, zinc hydroxide, barium sulfate, clay, kaolin, talc, surface-treated calcium and surface-treated silica; and finely-divided particles of organic fillers such as urea—formaldehyde resin, styrene—methacrylic acid copolymer, polystyrene resin and vinylidene chloride resin.

Examples of the lubricant for use in the present invention include higher fatty acids and amides, esters and metallic salts thereof; and a variety of waxes such as an animal wax, a vegetable wax, a mineral wax, and a petroleum wax.

It is preferable that the thermosensitive recording material of the present invention further comprise an intermediate layer comprising as the main component plastic void particles in the form of sphere, which is provided between the support and the thermosensitive coloring layer. This intermediate layer serves as a heat-insulating layer. Owing to the intermediate layer, therefore, thermal energy supplied by a thermal head can efficiently be utilized, thereby improving the thermosensitivity of the recording material.

The void particles for use in the intermediate layer comprise a thermoplastic resin for forming a shell of each void particle. A copolymer resin mainly comprising vinylidene chloride and acrylonitrile is preferably used as the above-mentioned thermoplastic resin. Air or other gasses are contained in the void particles in the expanded state.

It is preferable that the average particle diameter of the void particles be 2 to 10 μm in the present invention. When the particle size of the void particles is within the above range, there is no problem in the production of the intermediate layer because the voidage of the void particles can freely be determined. In addition, the surface smoothness of the intermediate layer is not decreased after coating and drying the liquid comprising the void particles, so that the adhesion of the thermosensitive coloring layer to the thermal head does not lower, and consequently, the thermosensitivity of the recording material can be prevented from deteriorating. When consideration is given to the above-mentioned advantages, it is preferable that the void particles classified in a narrow distribution be employed in the intermediate layer.

It is preferable that the voidage of the void particles for use in the intermediate layer be 50% or more, and more preferably 90% or more, from the viewpoint of the heat insulating effect. In the present invention, the voidage of the void particles for use in the intermediate layer is expressed by the following formula:

$$\text{Voidage (\%)} = \frac{\text{(inner diameters of void particles)}}{\text{(outer diameters of void particles)}} \times 100$$

When the voidage of the void particles is within the above range, sufficient heat insulating effect of the intermediate layer can be obtained, so that the thermal energy supplied by the thermal head is prevented from escaping through the support of the thermosensitive recording material. As a result, the thermosensitivity-improving effect can be increased.

In the present invention, when the intermediate layer comprises the void particles with an average particle diameter of 2 to 10 μm and a voidage of 90% or more, the flexibility of the obtained recording material is so much increased that the adhesion to the thermal head is further increased, thereby improving the dot reproduction performance.

The intermediate layer for use in the present invention may further comprise an inorganic or/and an organic pigment. In this case, the oil absorption of the pigment is preferably 30 ml/100 g or more, and more preferably, 80 ml/100 g or more.

The above-mentioned inorganic and/or organic pigment used in the intermediate layer, which may be employed alone or in combination, can be selected from any pigments used in the conventional thermosensitive recording materials. Specific examples of the inorganic pigment are calcium carbonate, silica, zinc oxide, titanium oxide, aluminum hydroxide, zinc hydroxide, barium sulfate, clay, talc, and surface-treated calcium and silica. Specific examples of the organic pigment are urea-formaldehyde resin, styrene—methacrylic acid copolymer and polystyrene resin.

In the present invention, the thermosensitive recording material may further comprise a protective layer, which is formed on the thermosensitive coloring layer. In this case, it is preferable that the protective layer comprise as the main components polyvinyl alcohol, and an aziridine compound or dimethylol urea.

The preservation stability of the images recorded in the thermosensitive recording material of the present invention is improved because the color developer for use in the thermosensitive coloring layer comprises at least one compound with an acid dissociation constant of 7.0 or less. When the protective layer comprising polyvinyl alcohol, and an aziridine compound or dimethylol urea is overlaid on the thermosensitive coloring layer, the resistance to water is improved, and the preservability of the recorded images for an extended period of time in terms of the resistance to plasticizer and oil is also improved.

Examples of the aziridine compound used in the protective layer include 2,4-diethylene ureidetoluene, N,N'-hexamethylene-1,6-bis(1-aziridinecarboamide), N,N'-diphenylmethane-4,4'-bis(1-aziridinecarboamide), trimethylolpropane-tri-β-aziridinylpropionate, tetramethylolmethane-tri-β-aziridinylpropionate, bisisophthal-1-(2-methylaziridine), and trimethylolpropane-tri-β(2-methylaziridine)propionate. Of the above aziridine compounds, 2,4-diethylene ureidetoluene is most effective for use in the protective layer.

It is preferable that the amount of the aziridine compound or dimethylol urea be in the range of 0.01 to 1.0 part by weight, more preferably 0.03 to 0.5 parts by weight, to one part by weight of polyvinyl alcohol.

The thermosensitive recording material of the present invention may further comprise an additional layer comprising a pigment, a binder agent and a thermofusible material, when necessary, which is provided between the previously mentioned intermediate layer and the thermosensitive coloring layer.

Other features of this invention will become apparent in the course of the following description of exemplary embodiments, which are given for illustration of the invention and are not intended to be limiting thereof.

EXAMPLE 1

Formation of thermosensitive coloring layer

A mixture of the following components was separately pulverized in a porcelain ball mill for 2 days, so that a Liquid A, a Liquid B, and a Liquid C were prepared:

| | Parts by Weight |
|---|---|
| [Liquid A] | |
| 3-N,N-dibutylamino-6-methyl-7-anilinofluoran | 20 |
| 10% aqueous solution of polyvinyl alcohol | 20 |
| Water | 60 |
| [Liquid B] | |
| 4-(4'-phenoxybutoxy)phthalic acid (Compound No. 1 in Table 1) | 20 |
| 10% aqueous solution of polyvinyl alcohol | 20 |
| Water | 60 |
| [Liquid C] | |
| Silicon dioxide | 20 |
| Methyl cellulose | 20 |
| Water | 60 |

10 parts by weight of the Liquid A, 30 parts by weight of the Liquid B, 10 parts by weight of the Liquid C, and 10 parts by weight of a commercially available dispersion of zinc stearate (Trademark: "Hidorin Z-730", made by Chukyo Yushi Co., Ltd.) with a concentration of 30% were mixed to prepare a thermosensitive coloring layer coating liquid. The thus prepared thermosensitive coloring layer coating liquid was coated on a sheet of commercially available high quality paper with a basis weight of 52 g/m$^2$, serving as a support, and then dried so as to have a dye deposition amount of 0.5 g/m$^2$ on a dry basis, whereby a thermosensitive coloring layer was formed on the support.

The surface of the thermosensitive coloring layer thus obtained was subjected to calendering to have a surface smoothness of 500 to 600 sec in terms of Bekk's smoothness.

Thus, a thermosensitive recording material No. 1 according to the present invention was obtained.

EXAMPLE 2

Formation of intermediate layer

A mixture of the following components was stirred and dispersed, so that a coating liquid D for an intermediate layer was prepared:

| [Liquid D] | Parts by Weight |
|---|---|
| Dispersion of finely-divided void particles (copolymer resin comprising styrene and acryl as the main components) (solid content: 38 wt. %, average particle diameter: 0.7 μm, and voidage: 80%) | 30 |
| Styrene - butadiene copolymer latex | 10 |
| Water | 60 |

The thus obtained intermediate layer coating liquid was coated on a sheet of commercially available high quality paper with a basis weight of 52 g/m$^2$, serving as a support, and then dried so as to have a deposition amount of 5 g/m$^2$ on a dry basis, whereby an intermediate layer was formed on the support.

Then, the same thermosensitive coloring layer coating liquid as used in Example 1 was coated on the intermediate layer and then dried so as to have a dye deposition amount of 0.5 g/m$^2$ on a dry basis, whereby a thermosensitive coloring layer was formed on the intermediate layer.

The surface of the thermosensitive coloring layer thus obtained was subjected to calendering to have a surface smoothness of 500 to 600 sec in terms of Bekk's smoothness.

Thus, a thermosensitive recording material No. 2 according to the present invention was obtained.

EXAMPLE 3

The procedure for preparation of the thermosensitive recording material No. 2 in Example 2 was repeated except that the Liquid D used in formation of the intermediate layer in Example 2 was replaced by a Liquid E with the following formulation:

| [Liquid E] | Parts by Weight |
|---|---|
| Dispersion of finely-divided void particles (copolymer comprising vinylidene chloride and acrylonitrile as the main components) (solid content: 32 wt. %, average particle diameter: 5 μm, and voidage: 92%) | 30 |
| Styrene - butadiene copolymer latex (solid content: 47 wt. %) | 20 |
| Water | 60 |

Thus, a thermosensitive recording material No. 3 according to the present invention was obtained.

EXAMPLE 4

The procedure for preparation of the thermosensitive recording material No. 1 in Example 1 was repeated except that the Liquid B used in formation of the thermosensitive coloring layer in Example 1 was replaced by a Liquid F with the following formulation:

| [Liquid F] | Parts by Weight |
|---|---|
| 4-(2'-phenoxyethoxy)phthalic acid (Compound No. 2 in Table 1) | 20 |
| 10% aqueous solution of polyvinyl alcohol | 20 |
| Water | 60 |

Thus, a thermosensitive recording material No. 4 according to the present invention was obtained.

EXAMPLE 5

The procedure for preparation of the thermosensitive recording material No. 1 in Example 1 was repeated except that the Liquid B used in formation of the thermosensitive coloring layer in Example 1 was replaced by a Liquid G with the following formulation:

| [Liquid G] | Parts by Weight |
|---|---|
| 4-(3'-phenylpropyloxy)phthalic acid (Compound No. 3 in Table 1) | 20 |
| 10% aqueous solution of polyvinyl alcohol | 20 |
| Water | 60 |

Thus, a thermosensitive recording material No. 5 according to the present invention was obtained.

EXAMPLE 6

The procedure for preparation of the thermosensitive recording material No. 1 in Example 1 was repeated except that the Liquid B used in formation of the thermosensitive coloring layer in Example 1 was replaced by a Liquid H with the following formulation:

| [Liquid H] | Parts by Weight |
|---|---|
| Mono(2-hydroxyethyl) 5-nitroisophthalate (Compound No. 4 in Table 1) | 20 |
| 10% aqueous solution of polyvinyl alcohol | 20 |
| Water | 60 |

Thus, a thermosensitive recording material No. 6 according to the present invention was obtained.

EXAMPLE 7

The procedure for preparation of the thermosensitive recording material No. 1 in Example 1 was repeated except that the Liquid B used in formation of the thermosensitive coloring layer in Example 1 was replaced by a Liquid I with the following formulation:

| [Liquid I] | Parts by Weight |
|---|---|
| Monomethyl 5-nitroisophthalate (Compound No. 5 in Table 1) | 20 |
| 10% aqueous solution of polyvinyl alcohol | 20 |
| Water | 60 |

Thus, a thermosensitive recording material No. 7 according to the present invention was obtained.

EXAMPLE 8

The procedure for preparation of the thermosensitive recording material No. 1 in Example 1 was repeated except that the Liquid B used in formation of the thermosensitive coloring layer in Example 1 was replaced by a Liquid J with the following formulation:

| [Liquid J] | Parts by Weight |
|---|---|
| 2-benzylsulfonylbenzoic acid (Compound No. 6 in Table 1) | 20 |
| 10% aqueous solution of polyvinyl alcohol | 20 |
| Water | 60 |

Thus, a thermosensitive recording material No. 8 according to the present invention was obtained.

EXAMPLE 9

The procedure for preparation of the thermosensitive recording material No. 1 in Example 1 was repeated except that the Liquid B used in formation of the thermosensitive coloring layer in Example 1 was replaced by a Liquid K with the following formulation:

| [Liquid K] | Parts by Weight |
|---|---|
| 5-benzyloxycarbonyl isophthalic acid (Compound No. 7 in Table 1) | 20 |
| 10% aqueous solution of polyvinyl alcohol | 20 |
| Water | 60 |

Thus, a thermosensitive recording material No. 9 according to the present invention was obtained.

EXAMPLE 10

The procedure for preparation of the thermosensitive recording material No. 1 in Example 1 was repeated except that the Liquid B used in formation of the thermosensitive coloring layer in Example 1 was replaced by a Liquid L with the following formulation:

| [Liquid L] | Parts by Weight |
|---|---|
| 5-(1'-phenylethanesulfonyl)-isophthalic acid (Compound No. 8 in Table 1) | 20 |
| 10% aqueous solution of polyvinyl alcohol | 20 |
| Water | 60 |

Thus, a thermosensitive recording material No. 10 according to the present invention was obtained.

EXAMPLE 11

Formation of thermosensitive coloring layer

A thermosensitive coloring layer was formed on a support in the same manner as in Example 4.

Formation of protective layer

A mixture of the following components was separately dispersed in a ball mill for 2 hours using glass balls, so that a Liquid M and a Liquid N were prepared:

| | Parts by Weight |
|---|---|
| [Liquid M] | |
| 2,4-diethyleneureidetoluene | 10 |
| Water | 90 |
| [Liquid N] | |
| Aluminum hydroxide | 20 |
| Water | 80 |

5 parts by weight of the Liquid M, 5 parts by weight of the Liquid N, 10 parts by weight of a 10% aqueous solution of polyvinyl alcohol, and 0.3 parts by weight of a zinc stearate dispersion with a concentration of 30% were mixed to prepare a protective layer coating liquid. The thus prepared protective layer coating liquid was coated on the thermosensitive coloring layer and then dried so as to have a deposition amount of 3.5 g/m$^2$ on a dry basis, whereby a protective layer was formed on the thermosensitive coloring layer.

The surface of the protective layer thus obtained was subjected to calendering to have a surface smoothness of 500 to 600 sec in terms of Bekk's smoothness.

Thus, a thermosensitive recording material No. 11 according to the present invention was obtained.

EXAMPLE 12

The procedure for preparation of the thermosensitive recording material No. 11 in Example 11 was repeated except that the Liquid F used in formation of the thermosensitive coloring layer in Example 11 was replaced by the Liquid H used in Example 6.

Thus, a thermosensitive recording material No. 12 according to the present invention was obtained.

COMPARATIVE EXAMPLE 1

The procedure for preparation of the thermosensitive recording material No. 1 in Example 1 was repeated except that the Liquid B used in formation of the thermosensitive coloring layer in Example 1 was replaced by a Liquid O with the following formulation:

| [Liquid O] | Parts by Weight |
|---|---|
| 4,4'-isopropylidene diphenol (with an acid dissociation constant pKal ≈ pKa2 = 10.7 | 20 |
| 10% aqueous solution of polyvinyl alcohol | 20 |
| Water | 60 |

Thus, a comparative thermosensitive recording material No. 1 was obtained.

COMPARATIVE EXAMPLE 2

The procedure for preparation of the thermosensitive recording material No. 1 in Example 1 was repeated except that the Liquid B used in formation of the thermosensitive coloring layer in Example 1 was replaced by a Liquid P with the following formulation:

| [Liquid P] | Parts by Weight |
|---|---|
| 4-isopropoxy-4'-hydroxydiphenyl-sulfone (with an acid dissociation constant pKa = 8.27 | 20 |
| 10% aqueous solution of polyvinyl alcohol | 20 |
| Water | 60 |

Thus, a comparative thermosensitive recording material No. 2 was obtained.

EXAMPLE 13

The procedure for preparation of the thermosensitive recording material No. 11 in Example 11 was repeated except that 5 parts by weight of the liquid M used in formation of the protective layer in Example 11 were replaced by 1.25 parts by weight of a 25% aqueous solution of polyamide-epichlorohydrin resin.

Thus, a thermosensitive recording material No. 13 according to the present invention was obtained.

EXAMPLE 14

The procedure for preparation of the thermosensitive recording material No. 1 in Example 1 was repeated except that the Liquid A used in formation of the thermosensitive coloring layer in Example 1 was replaced by a Liquid Q with the following formulation:

| [Liquid Q] | Parts by Weight |
|---|---|
| 3-dibutylamino-7-(o-chloro-anilino)fluoran | 20 |
| 10% aqueous solution of polyvinyl alcohol | 20 |
| Water | 60 |

Thus, a thermosensitive recording material No. 14 according to the present invention was obtained.

EXAMPLE 15

The procedure for preparation of the thermosensitive recording material No. 1 in Example 1 was repeated except that the Liquid A used in formation of the thermosensitive coloring layer in Example 1 was replaced by a Liquid R with the following formulation:

| [Liquid R] | Parts by Weight |
|---|---|
| 3,3-bis(p-dimethylaminophenyl)-6-dimethylaminophthalide | 20 |
| 10% aqueous solution of polyvinyl alcohol | 20 |
| Water | 60 |

Thus, a thermosensitive recording material No. 15 according to the present invention was obtained. Each of the thermosensitive recording materials obtained in Examples 1 to 3 was loaded in a printing test apparatus equipped with a commercially available thin film head (made by Matsushita Electronic Components Co., Ltd.), and images were formed on each recording material under the conditions that the applied electric power was 0.68 W/dot and the period for one line was 10 ms/line, with the pulse width changed to 0.4 msec and 0.6 msec. The coloring density of the recorded image was measured by Mcbeth densitometer RD-914. The results are given in Table 2.

TABLE 2

| Example No. | Coloring Density of Image | |
|---|---|---|
| | 0.4 ms | 0.6 ms |
| Ex. 1 | 0.63 | 1.31 |
| Ex. 2 | 0.84 | 1.31 |
| Ex. 3 | 1.02 | 1.32 |

Furthermore, images were thermally printed on each of the thermosensitive recording materials in such a manner that a heating block of 150° C. was brought into contact with each recording material for one second with the application of a pressure of 2 kg/cm$^2$ thereto.

Then, each image-bearing sample was subjected to an oil resistance test and a plasticizer resistance test to evaluate the preservability of the recorded image.

The method of each test was as follows:

(1) Oil resistance test

A cotton seed oil was coated on the image area of each image-bearing sample. Each sample was allowed to stand at 40° C. in a dry atmosphere for 16 hours. After 16 hours, the density of the printed images was measured to evaluate the oil resistance. The results are shown in Table 3.

(2) Plasticizer resistance test

Three sheets of commercially available polyvinyl chloride wrap "Polymer Wrap 300" (Trademark), made by Shin-Etsu Polymer Co., Ltd. were overlaid on the image area of each image-bearing sample. Each sample was allowed to stand at 40° C. in a dry atmosphere with the application of a load of 5 kg for 16 hours. After 16 hours, the density of the printed images was measured to evaluate the plasticizer resistance. The results are shown in Table 3.

TABLE 3

| Example No. | Image Density | | |
|---|---|---|---|
| | At initial stage | Oil-resistance | Plasticizer-resistance |
| Ex. 1 | 1.31 | 1.26 | 1.22 |
| Ex. 2 | 1.32 | 1.28 | 1.22 |
| Ex. 3 | 1.34 | 1.27 | 1.24 |
| Ex. 4 | 1.33 | 1.31 | 1.21 |
| Ex. 5 | 1.28 | 1.13 | 1.01 |
| Ex. 6 | 1.37 | 1.37 | 1.20 |
| Ex. 7 | 1.35 | 1.00 | 1.03 |
| Ex. 8 | 1.28 | 1.25 | 0.96 |

TABLE 3-continued

| Example No. | Image Density | | |
|---|---|---|---|
| | At initial stage | Oil-resistance | Plasticizer-resistance |
| Ex. 9 | 1.40 | 1.35 | 1.22 |
| Ex. 10 | 1.32 | 1.28 | 1.23 |
| Comp. Ex. 1 | 1.33 | 0.28 | 0.20 |
| Comp. Ex. 2 | 1.34 | 0.30 | 0.22 |

Furthermore, each image-bearing sample obtained from the thermosensitive recording materials Nos. 4, 11 and 12 according to the present invention was subjected to the water resistance test. In the water resistance test, each image-bearing sample was immersed in tap water for 16 hours. After 16 hours, the density of the printed images was measured to evaluate the water resistance. The results are shown in Table 4.

TABLE 4

| Example No. | Image Density | |
|---|---|---|
| | At initial stage | After Water resistance Test |
| Ex. 4 | 1.33 | 0.80 |
| Ex. 11 | 1.31 | 1.18 |
| Ex. 12 | 1.36 | 1.28 |

Furthermore, a heating block of 150° C. was brought into contact with each of the thermosensitive recording materials No. 1 and No. 14 according to the present invention and the comparative thermosensitive recording material No. 1 with the application of a pressure of 2 kg/cm$^2$ for one second, so that image-bearing samples were obtained.

The PCS value was measured when the light of 680 nm was applied to each image-bearing sample. The results are shown in Table 5.

TABLE 5

| | Initial PCS Value (%) |
|---|---|
| Ex. 1 | 89 |
| Comp. Ex. 1 | 71 |
| Ex. 14 | 73 |

As can be seen from the results of the above-mentioned tests, the coloring thermosensitivity, and the density and the preservation stability of the recorded images are excellent in the thermosensitive recording material of the present invention. When the compound with an acid dissociation constant of 4.5 or less is used as the color developer in the thermosensitive recording material of the present invention, the results are further improved.

Japanese Patent Application No. 5-254720 filed on Sep. 17, 1993, Japanese Patent Application filed on Aug. 18, 1994, and Japanese Patent Application filed on Sep. 8, 1994, are hereby incorporated by reference.

What is claimed is:

1. A thermosensitive recording material comprising a support and a thermosensitive coloring layer formed on said support which comprises a leuco dye and a color developer capable of inducing color formation in said leuco dye upon application of heat thereto, with said color developer comprising a compound with an acid dissociation constant (pKa) of 7.0 or less in a mixed solvent of water and methanol with a volume ratio of 1:1.

2. The thermosensitive recording material as claimed in claim 1, wherein said compound for use in said color developer has an acid dissociation constant (pKa) of 4.5 or less.

3. The thermosensitive recording material as claimed in claim 2, wherein said leuco dye comprises 3-N,N-dibutylamino-6-methyl-7-anilinofluoran.

4. The thermosensitive recording material as claimed in claim 1, further comprising an intermediate layer formed between said support and said thermosensitive coloring layer.

5. The thermosensitive recording material as claimed in claim 4, wherein said intermediate layer comprises minute spherical void particles which comprise a thermoplastic resin.

6. The thermosensitive recording material as claimed in claim 1, further comprising a protective layer formed on said thermosensitive coloring layer.

7. The thermosensitive recording material as claimed in claim 6, wherein said protective layer comprises polyvinyl alcohol, and an aziridine compound or dimethylol urea.

8. The thermosensitive recording material as claimed in claim 1, wherein said leuco dye comprises 3-N,N-dibutylamino-6-methyl-7-anilinofluoran.

* * * * *

UNITED STATES PATENT AND TRADEMARK OFFICE

CERTIFICATE OF CORRECTION

PATENT NO. : 5,447,900

DATED : SEPTEMBER 5, 1995

INVENTOR(S) : HIDEO SUZAKI ET AL

It is certified that error appears in the above-indentified patent and that said Letters Patent is hereby corrected as shown below:

Column 4, line 63, Table 1, Compound No. 7, "pKa = 4.87" should read --pKa2 = 4.87--.

Column 7, line 61, "that." should read --that--.

Signed and Sealed this

Twenty-fifth Day of June, 1996

*Attest:*

*Attesting Officer*

BRUCE LEHMAN

*Commissioner of Patents and Trademarks*